US005089349A

United States Patent [19]

Kaiser

[11] Patent Number: 5,089,349

[45] Date of Patent: Feb. 18, 1992

[54] COMPOSITIONS AND METHOD FOR APPLYING COATINGS TO METALLIC SURFACES

[75] Inventor: Herbert J. Kaiser, St. Louis, Mo.

[73] Assignee: Calgon Corporation, Pittsburgh, Pa.

[21] Appl. No.: 361,087

[22] Filed: Jun. 5, 1989

[51] Int. Cl.[5] ..... C23C 22/07

[52] U.S. Cl. ..... 428/472.1; 106/1.22; 148/261; 148/270; 423/508

[58] Field of Search ..... 148/270, 261; 423/508; 106/1.22; 428/472.1

[56] References Cited

U.S. PATENT DOCUMENTS

| | | | |
|---|---|---|---|
| 1,359,972 | 11/1920 | Edison | 148/270 |
| 2,303,350 | 12/1942 | Fuller | 148/270 |
| 2,408,116 | 9/1946 | Hippel | 148/270 |
| 2,622,993 | 12/1952 | McCullough | 148/270 |
| 2,927,875 | 3/1960 | Muller | 148/270 |
| 2,937,594 | 5/1960 | Miesse | 148/270 |
| 3,647,568 | 3/1972 | Larson | 148/255 |
| 4,042,425 | 8/1977 | Ohashi | 148/270 |
| 4,149,909 | 4/1979 | Hamilton | 148/254 |
| 4,321,231 | 3/1982 | Gupta | 148/270 |
| 4,391,855 | 7/1983 | Geeck | 427/383.7 |
| 4,444,600 | 4/1984 | Aries | 148/270 |
| 4,595,424 | 6/1986 | Hacias | 148/261 |
| 4,639,295 | 1/1987 | Miyamoto et al. | 204/38.1 |
| 4,642,140 | 2/1987 | Noufi | 148/270 |
| 4,713,121 | 12/1987 | Zurilla et al. | 428/472.3 |
| 4,728,365 | 3/1988 | Jarvi | 148/270 |

FOREIGN PATENT DOCUMENTS

| | | | |
|---|---|---|---|
| 611152 | 12/1960 | Canada | 148/270 |
| 2352067 | 12/1977 | France | 148/270 |
| 1355642 | 11/1987 | U.S.S.R. | 148/270 |

OTHER PUBLICATIONS

Merck Index, Tenth Edition, pp. 8970–8971.

*Primary Examiner*—Jay H. Woo
*Assistant Examiner*—Jeremiah F. Durkin, II
*Attorney, Agent, or Firm*—W. C. Mitchell; M. C. Sudol, Jr.

[57] ABSTRACT

Compositions and method for applying a coating to a metallic surface characterized by the presence of tellurium and/or selenium.

4 Claims, No Drawings

COMPOSITIONS AND METHOD FOR APPLYING COATINGS TO METALLIC SURFACES

BACKGROUND OF THE INVENTION

This invention relates to compositions and a method for applying coatings to metallic surfaces. These coatings are characterized by the presence of tellurium and/or selenium.

As used herein, the term "coating" refers to a material bonded to the surface of a metal which differs chemically from the metal itself. A particular example of a coating is a phosphate-based conversion coating. Such a coating is formed by chemical interaction between a phosphate-containing coating composition and the metal substrate being treated.

Conversion coatings are used to enhance the corrosion resistance of treated metal surfaces and to improve the adherence of paints and other coatings to these surfaces. As practiced in the art, conversion coatings are generally applied to metallic surfaces as iron phosphate, zinc phosphate or manganese phosphate. For example, a conversion coating may be produced by contacting a metal surface with a composition comprising a phosphate source, an acid and an accelerator. Typical accelerators used for this purpose include molybdenum, vanadium, nickel and tungsten salts. The use of tellurium and/or selenium ion sources in coating compositions is not known in the art.

Prior to application of a conversion coating, the metallic surface to be treated is generally cleaned so as to remove oil, grease, and other impurities. These impurities may act as mechanical barriers to conversion coating compositions or solutions, and can either interfere with or completely prevent adherence of the conversion coating to the metallic surface.

After cleaning, the metallic surface is typically contacted with a conversion coating solution which usually comprises an acid, a phosphate source, an oxidizer and an accelerator. The surface is then generally rinsed with water to remove unreacted reagents and phosphate salts. Finally, a chromate, nitrate, or acid sealing rinse may be applied to the surface being treated, prior to painting.

Several disadvantages inherently plague conventional conversion coating methods, such as iron phosphate coating methods. Key among these is that iron phosphate processes generally produce coatings which provide less corrosion resistance than zinc phosphate coating processes. Since zinc phosphate processes are generally more complex and more costly to utilize, and are environmentally undesirable, there is a long-felt need in the art for a convenient, inexpensive method of providing corrosion-resistent conversion coatings. This need is met by the instant method and compositions.

It is therefore an object of this invention to provide compositions and a method for applying a uniform, durable coating to a metallic surface which provides corrosion resistance to the substrate being treated. This object is accomplished by utilizing coating compositions which contain tellurium and/or selenium ion sources to form a coating characterized by the presence of tellurium and/or selenium. Any metallic surface can be treated according to the instant invention, including but not limited to galvanized surfaces, stainless steel surfaces, mild steel surfaces and aluminum surfaces. The instant invention is especially effective relative to mild steel surfaces.

This and other objects of the instant invention are accomplished by the novel compositions and method disclosed herein. The instant coating compositions and method allow the application of uniform conversion coatings to metallic surfaces. The method can be utilized at any temperature up to boiling, and the resulting coating provides corrosion resistance to the substrate. The instant coatings also improve the appearance of paints and other coatings subsequently applied to treated metallic surfaces.

U.S. Pat. No. 3,647,568 discloses the use of copper salts in iron-containing phosphate compositions used to produce a red coating on carbon steel. The presence of iron causes the treated surface to be more corrosive if the process of this patent is used.

The MERCK INDEX, Tenth Edition, discloses that tellurium is a reagent which produces a black finish on silverware.

U.S. Pat. No. 4,713,121 discloses phosphate conversion coatings which contain first and second divalent metal elements, such as cobalt and zinc.

U.S. Pat. No. 4,391,855 discloses a coating method which utilizes compositions containing a powdered metal dispersed in a bonding material as a corrosion inhibitor.

U.S. Pat. No. 4,149,909 discloses the use of chlorates and bromates as accelerators and hydroxylamine sulfate as a reducing agent in phosphatizing compositions used to produce iron phosphate coatings.

U.S. Pat. No. 4,595,424 discloses phosphate coating solutions for use on zinc surfaces which contain a phosphate ion source, a zinc and/or manganese ion source and a complex of fluoride ions.

U.S. Pat. No. 4,634,295 discloses a method for improving corrosion resistance of metal substrates which requires application of a direct current to a previously zinc-phosphated metal surface in an acidic solution containing zinc, phosphate and chloride ions.

These references do not disclose or suggest the instant invention.

DETAILED DESCRIPTION OF THE INVENTION

This invention relates to compositions and a method for applying a coating to a metallic surface, wherein the method and compositions are characterized by the use and/or presence of tellurium and/or selenium ion sources. Novel substrate/coating compositions, which are characterized by the presence of tellurium and/or selenium in the coating, are also disclosed.

The instant invention also relates to the use of tellurium and/or selenium to improve the corrosion resistance of conversion coatings, and to conversion coatings which are characterized by the presence of tellurium and/or selenium, or tellurium or selenium compounds.

More particularly, the instant invention is directed to a method for applying a coating to a metallic surface which comprises:

(A) contacting said metallic surface with an effective amount of an aqueous coating composition which comprises:

a) about 0.1 to about 400,000 ppm, based on the weight of water in said aqueous coating composition, of an acid;

b) optionally, up to about 400,000 ppm, based on the weight of water in said aqueous coating composition, of phosphate ions;

c) optionally, up to about 200,000 ppm, based on the weight of water in said aqueous coating composition, of an oxidizer;

d) about 0.1 to about 100,000 ppm, based on the weight of water in said aqueous coating composition, of tellurium and/or selenium ions and e) the balance water; and (B) Optionally, rinsing and drying said metallic surface.

Relative to this method, the term "effective amount" refers to that quantity of coating composition necessary to provide intimate contact between the metal surface to be coated and the coating composition for a time adequate to allow a coating characterized by the presence of tellurium and/or selenium, preferably tellurium, to bond to the metallic surface being treated.

In the composition of this method, the acid is required to keep tellurium and/or selenium soluble. It is believed that the acid also facilitates the bonding of the tellurium and/or selenium coating with the metal surface being treated. The tellurium and/or selenium ion source provides the tellurium and/or selenium present in the coating formed on the substrate, which is the essence of the instant invention. Optionally, phosphate ion sources and/or oxidizers may be used. Phosphates and oxidizers facilitate preparation of the metallic substrate. Dry compositions comprising an acid, a tellurium or selenium ion source and, optionally, a phosphate source and/or an oxidizer can also be prepared. These dry compositions can then be added to water to form an aqueous concentrate or the final coating solution.

Additionally, effective amounts of surfactants may be added for cleaning, penetration and/or wetting purposes, and an effective amount of a fluoride source may be added for use on galvanized or aluminum surfaces. Other conventional additives used in conversion compositions, such as chelants, may also be added.

The instant invention is also directed to compositions comprising:

a) water;

b) about 0.1 to about 400,000 ppm, based on the weight of a), of an acid;

c) optionally, up to about 400,000 ppm, based on the weight of a), of phosphate ions;

d) optionally, up to about 200,000 ppm, based on the weight of a), of an oxidizer; and e) about 0.1 to about 100,000 ppm, based on the weight of a), of tellurium and/or selenium ions.

The instant compositions provide novel coatings which are characterized by the presence of tellurium and/or selenium. Such coatings are not known in the art. These coatings generally enhance the resistance to corrosion of treated metallic surfaces and improve the adherence of paints and other coatings to these surfaces. Prior to the application of the instant coatings, the surface to be coated is generally cleaned using some combination of chemical additives, mechanical scrubbing and water rinsing. Conventional conversion coating compositions, such as iron phosphate coating compositions, generally contain metals such as molybdenum, vanadium, nickel and/or tungsten salts to accelerate the coating process and to provide even, adherent coatings. The use of tellurium and/or selenium in coating compositions is not known in the art. Also, the inventor has surprisingly found that the instant tellurium and/or selenium coatings generally enhance corrosion resistance over that provided by conventional coating formulations.

Any acid can be used in the instant compositions. The preferred acids include, but are not limited to, polyfunctional organic acids selected from the group consisting of oxalic acid, tartaric acid, glutaric acid, glycolic acid, ethylenediamethyltetra acetic acid, 2,6-pyridinedicarboxylic acid, ascorbic acid, benzoic acid, nitrilotriacetic acid, maleic acid, adipic acid, chloroacetic acid, succinic acid, octanoic acid, hydroxybenzoic acid, cinnanic acid, molybdic acid, itaconic acid, acrylic acid, methacrylic acid, citric acid, acetic acid and hydroxyacetic acid. The more preferred acids are selected from the group consisting of citric acid, hydroxyacetic acid, acetic acid, tartaric acid, glutaric acid, succinic acid, chloro-acetic acid, glycolic acid and methacrylic acid. The most preferred acid is citric acid.

The instant compositions should contain about 0.1 to about 400,000 ppm of acid, based on the weight of water in the coating composition. Preferably, about 1.0 to about 200,000 ppm of the acid is present. It is believed that the acid passivates the treated metal substrate, and that the acid improves corrosion resistance.

Optionally, any source of phosphate ions can be used, including but not limited to phosphoric acid and phosphate salts, such as ammonium, potassium, lithium, or sodium salts of ortho phosphoric acid or pyro phosphoric acid. For example, suitable phosphate salts include but are not limited to mono potassium ortho phosphate, dipotassium ortho phosphate, tripotassium ortho phosphate, mono sodium ortho phosphate, disodium ortho phosphate, trisodium ortho phosphate, hemisodium ortho phosphate, mono ammonium ortho phosphate, diammonium ortho phosphate, triammonium ortho phosphate, lithium ortho phosphate, sodium tripolyphosphate, tetrasodium pyrophosphate, disodium pyrophosphate, sodium hexametaphosphate, sodium ammonium pyrophosphate, sodium octametaphosphate, and sodium heptametaphosphate. The preferred sources of phosphate ions are trimetaphosphates, orthophosphates, hexametaphosphates and tripolyphosphates. The most preferred phosphate ion source is sodium trimetaphosphate. The instant coating compositions may contain up to about 400,000 ppm, based on the total water in the coating composition, of phosphate ions, on an active basis. Preferably, these compositions contain about 1 to about 200,000 ppm of phosphate ions. It is believed that phosphate ions assist in maintaining tellurium and/or selenium solubility. The phosphates may also act as chelants and sludge reducers.

The instant coating compositions may optionally contain about up to about 200,000 ppm of an oxidizer, based on weight of water in the coating composition. Preferably, they contain about 1.0 to about 100,000 ppm of an oxidizer. Any oxidizer can be used. The preferred oxidizers are selected from the group consisting of chlorate and nitrate salts. The most preferred oxidizers are sodium chlorate and sodium nitrate.

The instant coating compositions contain at least about 0.1 ppm of tellurium and/or selenium ions on an active basis with the upper limit set by tellurium and/or selenium solubility, based on the weight of water in the coating composition. Preferably about 0.1 to about 100,000 ppm, and most preferably about 1 to about 50,000 ppm of tellurium and/or selenium ions are present. Tellurium ions are preferred. Any source of tellurium ions may be used. Preferred tellurium ion sources are the oxides of tellurium and salts of telluric acid or tellurous acid. The most preferred sources of tellurium ions are tellurium oxide and salts of telluric acid. Any source of selenium ions can be used. Preferred sources are selenium oxide and salts of selenic acid (selenates).

The balance of the instant composition is water, though additional agents may be used. For example, surfactants, fluoride ion sources and chelants may also be desirable.

An effective amount of a heavy metal catalyst can also optionally be used in the compositions of the instant invention. Such catalysts include, but are not limited to, compounds of such metals as vanadium, titanium, zirconium, tungsten, and molybdenum. The preferred catalysts are sodium molybdate and ammonium metavanadate. In combination with or in place of these heavy metal catalysts, additional accelerators such as acid-soluble salts of nickel, cobalt, magnesium, sodium and calcium may be utilized in the compositions of the instant invention. Typical anions for these salts include but are not limited to nitrates, nitrites and chlorates.

An effective amount of a chelating agent can also optionally be used in the instant invention. Such agents include, but are not limited to thiourea, ethylene diamine tetraacetic acid, and nitrolotriacetic acid. The preferred chelant is ethylene diamine tetraacetic acid (hereinafter EDTA). The EDTA component of the composition may be of any suitable grade. For example, commercially available solutions which are 39%, by weight, may be used. It is noteworthy that some acids, such as citric acid and EDTA, are well-known chelants.

The inventor has also discovered that dextrose may be used in the instant compositions and method. The dextrose is believed to assist in maintaining tellurium and/or selenium solubility, to act as a crystal modifier and to improve corrosion resistance. Up to about 400,000 ppm of dextrose, based on the weight of water in the coating composition, may be used.

The compositions of the present invention must contact the metal being treated for an effective amount of time. As used herein, "effective amount of time" means that amount of time required for the composition to contact and to react with the metallic surface being treated so as to produce a uniform, adherent coating. Preferably, the contact time should be about 1-60 minutes, more preferably about 1-30 minutes and most preferably, about 1-5 minutes. Contact between the coating composition and the metal surface can be made to occur by any known method, including but not limited to spraying and immersion techniques. While application temperature is not believed to be critical, a practical upper limit is the boiling temperature of the aqueous coating composition. However, the preferred contact temperature is less than about 120° F.

Application pH, i.e., the pH of the coating composition, is not believed to be critical. Preferably, however, the pH should be less than about 10. More preferably, the pH should be from about 2.0 to about 8.5, and most preferably from about 3.0 to about 8.0. Sodium hydroxide can be used to adjust pH.

A preferred composition comprises:

| | Weight Percent (Active Basis) |
|---|---|
| Organic Acid | 2-20 |
| Phosphate Ion Source | 1-20 |
| Oxidizer | 0.5-10 |
| Tellurium and/or Selenium Ion Source | 0.01-3 |
| Water | Balance |

Dry contrates of the instant compositions, which contain dry constituents in the ratios shown above, may be prepared for dilution with water prior to treatment of a metallic substrate.

Optionally, the compositions of the present invention may contain about 0.1% to 5%, by weight, of a heavy metal catalyst and about 0.1% to 10%, by weight, of a chelating agent. Also, at least 0.1, by weight, preferably about 0.1% to about 10%, by weight, of a fluoroborate compound may be used to provide fluoride ions to etch the metallic surface being treated.

The compositions of the instant invention may be prepared by conventional mixing or blending techniques in a mix tank. Agitation is desirable. Order of addition is not believed to be critical.

The compositions of the instant invention may be applied to a metallic surface by any known method of application including but not limited to spray and immersion techniques. Optionally, the coating composition can then be rinsed and allowed to dry, which leaves the coating behind.

The process described herein may be followed by or may additionally comprise other steps conventionally used in preparing metallic surfaces for painting, including but not limited sealing the coated metallic surface with chromic or non-chromic based materials.

Advantages of the invention over prior methods of achieving conversion coatings include, but are not limited to:

(a) the ability to produce coatings rapidly and inexpensively at low temperatures;
(b) the ability to formulate products which produce minimal corrosion to equipment;
(c) the ability to obtain uniform coatings;
(d) the ability to obtain coatings which are corrosion resistant; and
(e) the ability to formulate products so as to allow the preparation of coating composition concentrates, which are diluted with water at the point of treatment.

The inventor has discovered that tellurium and/or selenium ions are incorporated into the molecular structure of coatings found on metallic substrates which are contacted with the instant coating compositions. When speaking of coatings which are "characterized by" the presence of tellurium and/or selenium, it is meant that tellurium and/or selenium ions are integrally included in the molecular structure of the coating.

EXAMPLES

EXAMPLES 1-4

The following examples demonstrate the instant coating compositions and method. These examples are not meant to limit the instant invention in any way.

The following coating formulations were prepared:

| Ingredient | Weight % 1 | 2 | 3 | 4 |
|---|---|---|---|---|
| Zeolite Softened Water | 79.93 | 77.93 | 77.93 | 77.43 |

-continued

| Ingredient | Weight % 1 | 2 | 3 | 4 |
|---|---|---|---|---|
| Sodium Trimetaphosphate | 6.70 | 7.70 | 6.70 | 6.70 |
| Tartaric Acid | 10.00 | — | — | 10.00 |
| Oxalic Acid | — | 10.00 | — | — |
| Citric Acid | — | — | 10.00 | — |
| Sodium Nitrate | 5.00 | — | — | — |
| Sodium Chlorate | — | 5.00 | 5.00 | 5.00 |
| 27.3% Tellurium Oxide | 0.37 | 0.37 | 0.37 | 0.37 |

The above described formulations were used to produce coatings characterized by the presence of tellurium on mild steel coupons by spraying the coupons with the compositions for approximately two (2) minutes. Scanning electron microscopy and electron diffraction techniques were used to verify the presence of tellurium in the coatings formed.

EXAMPLE 5

Mild steel wires were immersed in solutions containing varying amounts of the ingredients shown below at a temperature of approximately 120° F. for 4 minutes at pH 3. The wires were then removed from the solutions, rinsed in water and dried. Tellurium-containing coatings were formed on the wires. The wires were then immersed in a 5% sodium chloride solution at 100° F. for a period of 4 hours. Following exposure to NaCl, the wires were removed from the solutions and the solutions were analyzed for iron, utilizing standard analytical methods. The value obtained was then divided by the value obtained from a wire which had not been treated with any coating composition to determine corrosion ratios, as defined below:

$$\text{Corrosion Ratio} = \frac{\text{Fe concentration from treated wire}}{\text{Fe concentration from untreated wire}}$$

Results of these experiments are shown in Table I. In Table I, $NaClO_4$ is sodium chlorate, STMP is sodium trimetaphosphate and Te is active tellurium content.

| [Citric Acid] ppm | [NaClO4] ppm | [STMP] ppm | [Te] ppm | Corrosion Ratio |
|---|---|---|---|---|
| 480 | 120 | 240 | 2 | 1.19 |
| 480 | 120 | 240 | 70 | 0.91 |
| 480 | 120 | 240 | 200 | 0.86 |
| 480 | 120 | 1800 | 70 | 0.93 |
| 480 | 120 | 3600 | 70 | 0.71 |
| 2400 | 120 | 1800 | 70 | 0.78 |
| 4800 | 120 | 1800 | 70 | 0.62 |
| 2500 | 720 | 1800 | 70 | 1.20 |
| 2400 | 1400 | 1800 | 70 | 1.16 |
| 2500 | 120 | 240 | 2 | 1.14 |
| 4900 | 120 | 240 | 2 | 0.67 |
| 2500 | 120 | 1800 | 2 | 0.75 |
| 2500 | 120 | 3600 | 2 | 0.74 |
| 2400 | 720 | 3600 | 2 | 0.82 |
| 2400 | 1400 | 3600 | 2 | 0.79 |
| 4800 | 1400 | 3600 | 2 | 0.92 |
| 480 | 120 | 1800 | 2 | 0.75 |
| 480 | 120 | 1800 | 200 | 0.99 |
| 480 | 120 | 3600 | 200 | 1.29 |
| 480 | 720 | 240 | 2 | 0.59 |
| 480 | 720 | 240 | 70 | 0.88 |
| 480 | 720 | 240 | 200 | 0.95 |
| 480 | 720 | 1800 | 2 | 0.72 |
| 480 | 720 | 1800 | 70 | 0.81 |
| 480 | 720 | 1800 | 200 | 1.12 |
| 480 | 720 | 3600 | 2 | 1.04 |
| 480 | 720 | 3600 | 70 | 1.22 |
| 480 | 720 | 3600 | 200 | 1.17 |
| 480 | 1500 | 240 | 2 | 1.00 |
| 480 | 1500 | 240 | 70 | 1.20 |
| 480 | 1500 | 240 | 200 | 1.34 |
| 480 | 1500 | 1800 | 2 | 1.31 |
| 480 | 1500 | 1800 | 70 | 1.05 |
| 480 | 1500 | 1800 | 200 | 1.09 |
| 480 | 1500 | 3600 | 2 | 0.70 |
| 480 | 1500 | 3600 | 70 | 0.73 |
| 480 | 1500 | 3600 | 200 | 0.98 |
| 4900 | 120 | 240 | 70 | 0.90 |
| 4900 | 120 | 240 | 200 | 1.08 |
| 4900 | 120 | 1800 | 70 | 0.96 |
| 4900 | 120 | 1800 | 200 | 1.36 |
| 4800 | 120 | 3600 | 2 | 1.02 |
| 4800 | 120 | 3600 | 70 | 1.22 |
| 4800 | 120 | 3600 | 200 | 1.14 |
| 4900 | 720 | 240 | 2 | 1.05 |
| 4900 | 720 | 240 | 70 | 1.06 |
| 4900 | 720 | 240 | 200 | 1.13 |
| 4900 | 720 | 1800 | 2 | 1.00 |
| 4900 | 720 | 1800 | 70 | 1.07 |
| 4800 | 720 | 1800 | 200 | 0.66 |
| 4800 | 710 | 3600 | 70 | 0.36 |
| 4800 | 710 | 3600 | 200 | 1.06 |
| 4900 | 1500 | 240 | 2 | 0.40 |
| 4900 | 1500 | 240 | 70 | 0.48 |
| 4900 | 1500 | 240 | 200 | 0.70 |
| 4800 | 1500 | 1800 | 2 | 0.53 |
| 4800 | 1500 | 1800 | 70 | 0.44 |
| 4800 | 1500 | 1800 | 200 | 0.70 |
| 4800 | 1500 | 3600 | 70 | 0.54 |
| 4800 | 1500 | 3600 | 200 | 0.77 |
| 2500 | 120 | 240 | 70 | 0.98 |
| 2500 | 120 | 240 | 200 | 0.66 |
| 2500 | 120 | 1800 | 200 | 0.83 |
| 2500 | 120 | 3600 | 70 | 0.81 |
| 2500 | 120 | 3600 | 200 | 0.88 |
| 2500 | 720 | 3600 | 70 | 1.05 |
| 2500 | 720 | 3600 | 200 | 1.08 |
| 2500 | 720 | 240 | 2 | 0.66 |
| 2500 | 720 | 240 | 70 | 1.34 |
| 2500 | 720 | 240 | 200 | 0.91 |
| 2500 | 1500 | 240 | 2 | 0.72 |
| 2500 | 1500 | 240 | 70 | 1.43 |
| 2500 | 1500 | 240 | 200 | 1.53 |
| 2500 | 1500 | 1800 | 2 | 1.64 |
| 2500 | 1500 | 1800 | 200 | 1.65 |
| 2500 | 1500 | 3600 | 2 | 1.20 |
| 2500 | 1500 | 3600 | 70 | 1.37 |
| 2500 | 1500 | 3600 | 200 | 0.86 |
| 3600 | 600 | 1400 | 2 | 0.78 |
| 3600 | 600 | 1400 | 0 | 1.00 |
| 3600 | 0 | 1400 | 2 | 0.81 |
| 3600 | 600 | 0 | 2 | 0.86 |
| 0 | 600 | 1400 | 2 | 0.72 |
| 0 | 0 | 0 | 0 | 1.05 |

What is claimed is:

1. A composition for applying a coating to a metallic surface comprising:

a) water;

b) about 0.1 to about 400,000 ppm, based on the weight of a), of an acid;

c) about 0.1 to about 400,000 ppm, based on the weight of a), of phosphate ions; and d) a tellurium ion source, wherein said tellurium ion source is selected from the group consisting of oxides of tellurium, salts of telluric acid and salts of tellurous acid, and wherein said tellurium ion source causes at least about 0.1 ppm of tellurium ions to be present in said composition, based on the weight of a).

2. An article comprising:

a) a metallic substrate; and b) a coating containing tellurium, wherein said coating is applied to said substrate by contacting said substrate with an effective amount of the composition of claim 1.

3. A coating bonded to a metallic substrate, wherein said coating contains tellurium and wherein said coating is applied to said substrate by contacting said substrate with an effective amount of the composition of claim 1.

4. A method for applying a coating to a metallic surface which comprises:

A) contacting said metallic surface with an effective amount of an aqueous coating composition which comprises:

a) about 0.1 to about 400,000 ppm, based on the weight of water in said aqueous coating composition, of an acid;

b) about 0.1 to about 400,000 ppm, based on the weight of water in said aqueous coating composition, of phosphate ions;

c) a tellurium ion source, wherein said tellurium ion source is selected from the group consisting of oxides of tellurium, salts of telluric acid and salts of tellurous acid, and wherein said tellurium ion source causes at least about 0.1 ppm of tellurium ions to be present in said composition, based on the weight of water in said composition; and d) the balance water; and B) rinsing and drying said metallic surface.

* * * * *